US005391074A

United States Patent [19]

Meeker

[11] Patent Number: 5,391,074

[45] Date of Patent: Feb. 21, 1995

[54] ATMOSPHERIC GAS BURNER AND CONTROL SYSTEM

[76] Inventor: John Meeker, 24 Jamestown St., Sinclairville, N.Y. 14782-0568

[21] Appl. No.: 189,402

[22] Filed: Jan. 31, 1994

[51] Int. Cl.[6] ..... F23N 5/20

[52] U.S. Cl. ..... 431/6; 431/80; 126/512; 126/85 R; 110/186

[58] Field of Search ..... 431/6, 22, 80; 126/512, 126/85 R; 110/186, 187

[56] References Cited

U.S. PATENT DOCUMENTS 3,034,571 5/1962 Matthews ..... 431/80
3,111,161 11/1963 Frege et al. .
3,124,194 3/1964 Fuchs .
3,291,649 12/1966 Craemer et al. .
3,321,001 5/1967 Vezzoli ..... 431/22
3,542,501 11/1970 Jones et al. .
3,605,655 9/1971 Warshawsky et al. ..... 110/186
3,787,169 1/1974 Gjerde .
4,078,541 3/1978 Roycraft .
4,121,979 10/1978 Wake .
4,123,979 11/1978 Tesch .
4,207,053 6/1980 Turner et al. .
4,207,054 6/1980 Sobole .
4,318,687 3/1982 Inoue .
4,515,089 5/1985 Ehrlichmann .
4,655,705 4/1987 Shute et al. .
5,007,404 4/1991 Hall et al. .
5,179,933 1/1993 McCrillis et al. .

*Primary Examiner*—Carroll B. Dority
*Attorney, Agent, or Firm*—Pennie & Edmonds

[57] ABSTRACT

A gas and solid fuel burning chamber is provided with a control system for the safe and efficient operation of a gas burner. The simple control system uses multiple thermocouples in series to permit the safe operation of the gas burner in a vented device without the need for a draft hood. A combination of gas and solid fuel is demonstrated where gas can be used to start the solid or as an independent source of heat. The control system comprises generally of thermocouples for measuring the flame temperature, the combusted gas temperature and the overall chamber internal temperature and producing signals to regulate the flow of fuel to the gas burner in response thereto.

23 Claims, 3 Drawing Sheets

ATMOSPHERIC GAS BURNER AND CONTROL SYSTEM

TECHNICAL FIELD

The invention relates generally to the field of atmospheric heating devices such as fireplaces and more particularly to the manufacture of a gas burner in such a heating device and a control system therefore.

BACKGROUND OF THE INVENTION

Gas burners have been used in fireplaces and similar heating devices both as a primary heat source, often with ceramic logs, and as a wood starter. Gas burners burn cleaner than wood and provide a simple, clean way to start wood fires.

While gas burners have advantages, they can impose the serious threat of gas leakage from a non-burning gas source. When gas is allowed to escape under the atmospheric pressure conditions, it can form a highly explosive and generally toxic mixture with the ambient air.

Prior art gas burners for wood fire starting also require manual shutoff. Thus, if a casual user forgets to turn off the gas supply, the gas will remain burning wasting fuel.

Various safety systems have been designed to protect against gas leakage when the burner fails to light or when there exists a temporary interruption in the gas supply. Such systems include the traditional draft hood, measuring pilot burner temperature as in U.S. Pat. No. 3,111,161 and measuring the temperature in a blast tube of a power gas burner as in U.S. Pat. No. 4,655,705. However, these systems do not provide automatic controls for a solid fuel starter. Furthermore, the draft hood is inefficient as a safety device because it draws unnecessary air out of the home, and when combined with spillage detection, it becomes expensive to operate. Powered burners are also costly and have not gained wide acceptance in dual fuel appliances.

Having the ability to burn either gas or solid fuel in the same combustion chamber gives the user the option of what fuel to use and makes starting a wood fire easier and cleaner. While gas fire starters for fireplaces have been used for many years, they generally do not have optimum safety controls and are generally not approved for use with liquid propane gas which is heavier than air.

SUMMARY OF THE INVENTION

An object of the current invention is to provide a gas burning heating device that uses a thermocouple control system that eliminates the need of a draft hood. Another object of the present invention is to provide a heating device that operates alternatively as a gas burning device or as solid fuel burning device that incorporates an automatic gas starter. Still another object of the present invention is to provide a gas burner for a heating device that can utilize at least liquid propane or natural gas as fuel.

An improved gas assisted atmospheric burning chamber and control system has been developed according to the present invention which substantially overcomes the drawbacks of the prior art gas burners discussed above.

The present invention provides a gas burner for use as a primary source of heat or as a solid fuel fire starter. The present invention also provides a gas burner that can be operated from both natural gas or liquid propane gas.

In addition, the present invention provides a control system for a gas burner that provides safe and efficient operation of the gas burner. The control system allows for the automatic shutoff of the gas burner in the event of loss of flame or once the solid fuel fire is sufficiently burning. This prevents gas leakage when no flame exists and eliminates wasted gas flow when the wood fire is burning sufficiently. Moreover, the gas burner and control system according to the present invention is a simple system that is low cost.

The present invention thus involves providing a gas burner for a atmospheric heating chamber and control system for the safe and efficient operation of the gas burner.

The present invention also includes a variable flow valve. The valve is preferably operated by a manual valve knob and a solenoid, actuated in response to signals generated by temperature sensors. Temperature sensors such as thermocouples are placed according to the invention to measure gas flame temperature, flue flow temperature and solid fuel fire temperature. In a preferred embodiment, the temperature sensors provide control signals such that the signal from the solid fuel fire temperature is opposed to the signals from the gas flame temperature and flue flow temperature.

The solenoid operates the valve such that the valve remains open when the gas burner is utilized as the primary heat source. The solenoid will also close the valve in the event of a flame out or backdraft in the flue as determined by the corresponding temperature sensor. When the gas burner is used as a solid fuel fire starter, the solenoid automatically closes the valve after the solid fuel has sustained ignition. In this mode, the solenoid automatically shuts the valve when the solid fuel fire is generating enough heat to be self sufficient.

Additional advantages of the present invention include the gas burner being located in the upper rear of the heating chamber at the base of a refractory baffle which reflects the gas heat toward the solid fuel and the glass front of the appliance, which is preferably an efficient, semi-airtight EPA approved wood heater. A flue damper can be used to regulate the air supply to provide for better heating efficiency.

Another advantage of the present invention is that the primary air for the gas source is supplied by a shutterless intake combined with a shrouded orifice construction. This provides good gas/air mixing with both natural and liquid propane gas without the necessity of having access for the purpose of adjustment.

Other details, features, objects, uses and advantages of this invention will become apparent from the embodiments thereof presented in the following specification and claims, as well as in the enclosed drawing.

BRIEF DESCRIPTION OF THE DRAWINGS

The invention will be better understood if reference is made to the accompanying drawings, in which.

DETAILED DESCRIPTION OF THE INVENTION

Figure 1:
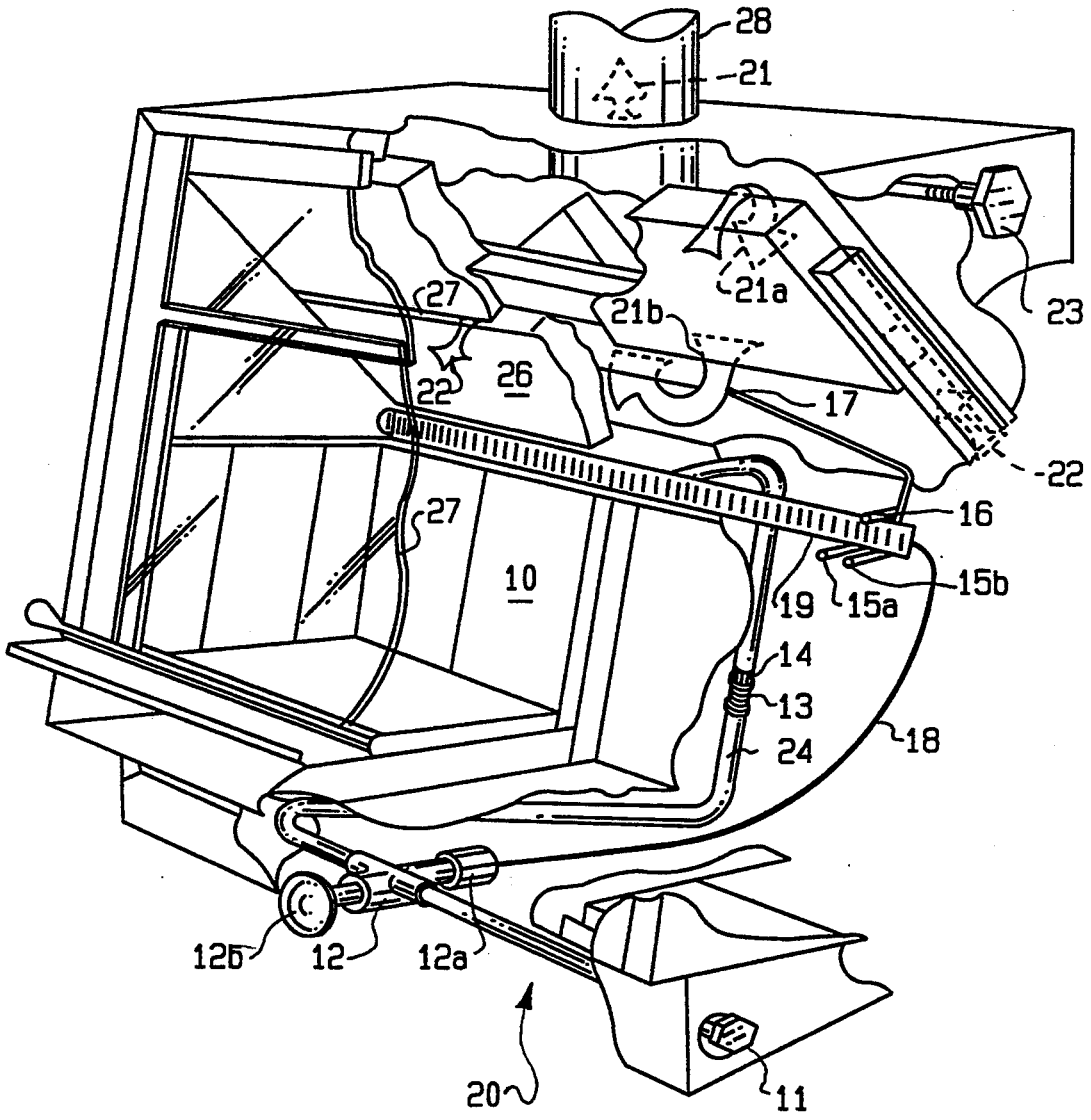
FIG. 1 is a partial cut-away perspective view of an atmospheric heater with a gas source and control system in accordance with the invention.

Referring to FIG. 1, a heating chamber 10 is provided to be used for solid fuel burning or gas burning. Gas is supplied to a gas controlling system 20 at an inlet 11 from a source not shown. For domestic use, the present invention preferably uses 11" WC LP gas (normal house pressure liquid propane) or 7" WC NAT gas (normal house pressure natural gas) or equivalents thereof.

A valve 12 regulates the gas flow to the heating chamber 10. The variable flow valve 12 is sized so that it gives reasonable adjustment of gas flow according to the gas and amount of heating desired. In an exemplary embodiment for a domestic use, valve 12 may be sized to provide approximately 20,0000 BTU/HR for the appropriate gas flow when using either of the above-mentioned gasses.

Valve 12 includes two operating mechanisms. Valve knob **12*b* is provided to operate the valve manually. An actuator 12*a*, which is preferably a solenoid 12*a*, is provided to automatically operate the valve 12 according to control signals. For simplicity, valve 12 may be a push/pull valve so that the valve knob 12*b* and solenoid 12*a* can adjust the flow rate through valve 12 through simple translational movement. In this manner the valve knob 12*b* can be depressed to open valve 12 against the closure force of the solenoid 12*a*. Once the solenoid 12*a* receives open signals, the valve 12 will remain open without pressure on the valve knob 12*b***.

Figure 2:
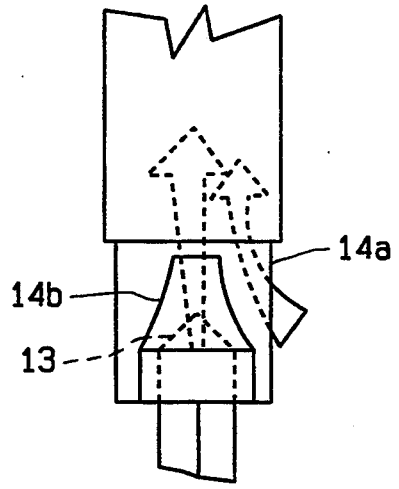
FIG. 2 is a schematic view of the shutterless primary air system in the gas supply.

The gas that passes through valve 12 is supplied to gas burner 19 via a fuel flow path comprising piping 24. Shutterless intake 14 and orifice 13 can be inserted in piping 24 to mix the gas with primary air and create a gas/air mixture for combustion. FIG. 2 shows orifice 13 recessed in shroud **14*b* which expands the gas before it is mixed with air which is inducted through the intake holes 14*a*. The shroud 14*b* also gives the mixing air proper flow direction for a preferred mixing. The orifice 13** can be properly sized according to the gas type desired. For instance, a No. 53 drill can be used for liquid propane and a No. 47 drill can be used for natural gas.

The gas or gas/air mixture is supplied to the gas burner 19 where it is combusted. The burner 19 is located within the heating chamber 10 to direct the combustion heat toward a solid fuel such as wood, not shown. This allows the heating chamber 10 to be used as a dual mode heater. In a first mode, no solid fuel is supplied and the gas burner 19 is used as the primary heat source. In a second mode, solid fuel is provided and the gas burner 19 is used for igniting the solid fuel and automatically shuts off thereafter.

Preferably, gas burner 19 is located in heating chamber 10 at the base of a refractory baffle 26 at the upper back of the heating chamber. In the preferred embodiment shown in FIGS. 1, 6 and 7, air 22 is introduced into the chamber 10 through a slot 27 in the refactory baffle 26 and is mixed and combusted with the gas to form combusted gas 21. The combusted gas 21 flows from the gas burner 19 toward the center of the heating chamber 10 where a solid fuel source can be located. The combusted gas flows, as indicated by arrow **21*a*, from the heating chamber 10 over and behind the refractory baffle 26. The combusted gas then flows (arrow 216) across a temperature sensor 17. Finally, the combusted gas flows in the direction of arrow 21*c* into a flue 28** where it is directed to outside, ambient conditions.

A traditional flue damper 23 can be used to regulate the air flow and provide for further heating efficiency of the heating chamber 10. Air flow indicated by arrow 22 is inducted from ambient conditions and then introduced into the heating chamber part way up the baffle 26 through the slot 27. This provides an air flow from the back of the heating chamber 10 so that the top front of the heating chamber 10 receives the greatest amount of heat.

Figure 4:
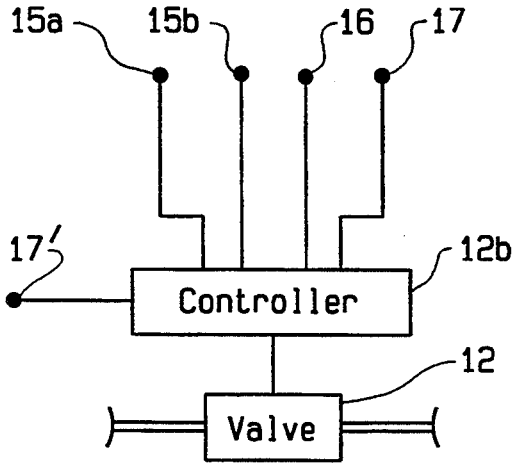
FIG. 4 is a schematic diagram of an alternate control system.

In a preferred embodiment, four temperature sensors **15*a*, 15*b*, 16 and 17 communicate with solenoid 12*a* to control the gas flow. Preferably the temperature sensors are coupled to solenoid 12*a*. The temperature sensors according to a preferred embodiment are connected in a series relationship to control the solenoid 12*a* so that the signal received from the thermocouples 15*a*, 15*b*, 16 and 17 is based on the additive effect of the temperatures sensed. As one skilled in the art can appreciate, temperature sensors 15*a*, 15*b*, 16 and 17 could provide separate signals to a microprocessor or other logic center for controlling solenoid 12*a* as shown in FIG. 4. Other inputs 17', such as room temperature could be provided, and valve controller 12*b* can provide flow control for valve 12** so as to provide temperature control as well as the safety features discussed herein.

Figure 6:
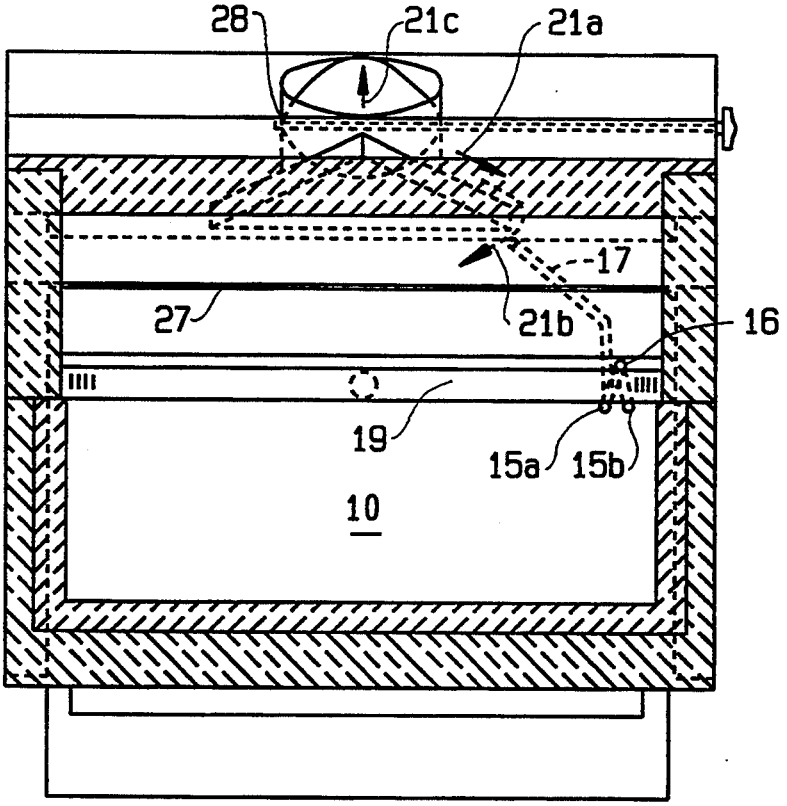
FIG. 6 is cross section of an atmospheric heater with a gas source and temperature sensors according to the present invention from a frontal view.
Figure 7:
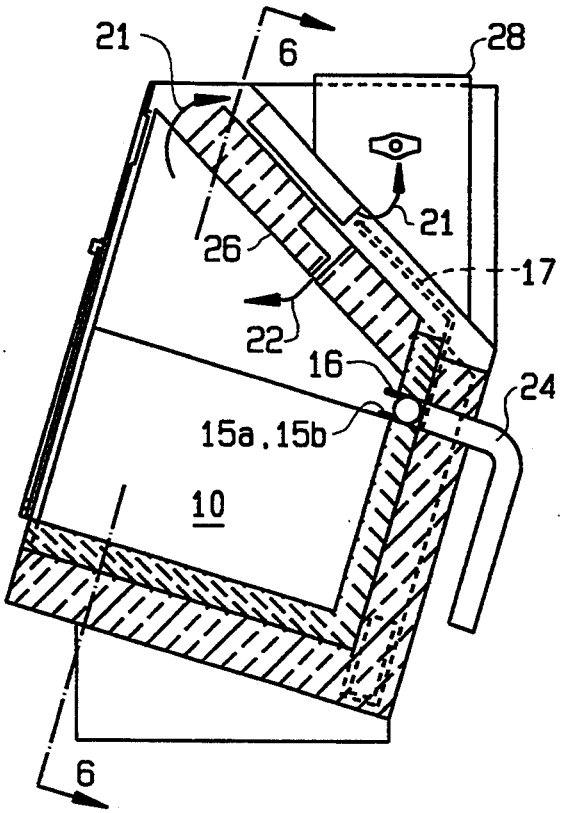
FIG. 7 is cross section of an atmospheric heater with a gas source and temperature sensors according to the present invention from a side view.

Again, according to a preferred embodiment, a first thermocouple 16 is located on top of the burner 19 to sense the gas flame temperature and serves to hold the valve 12 open for gas flow after ignition of the gas burner 19. A second thermocouple 17 is located approximate the base of the flue 28 to sense the flue flow temperature as shown in FIGS. 6 and 7. The thermocouple 17 is insulated from the combustion chamber by the refractory baffle 26. Thermocouple 17 provides a signal that supports the signal of thermocouple 16 as the flame and combustion gas temperatures increase to hold the valve 12 open after ignition of the gas burner 19. Two thermocouples **15*a* and 15*b* are located under the gas burner 19 to sense the temperature of heating chamber 10. In particular, the thermocouples 15*a* and 15*b* are located to primarily sense heat from the solid fuel source not shown, but they also sense the temperature of the heating chamber 10 as a whole. Heat sensors 15*a* and 15*b*** thus may be differently positioned depending on factors such as size, shape or capacity of the combustion chamber. The exact position for these heat sensors will be easily determined by persons of ordinary skill in the art based on the teachings herein.

Figure 3:
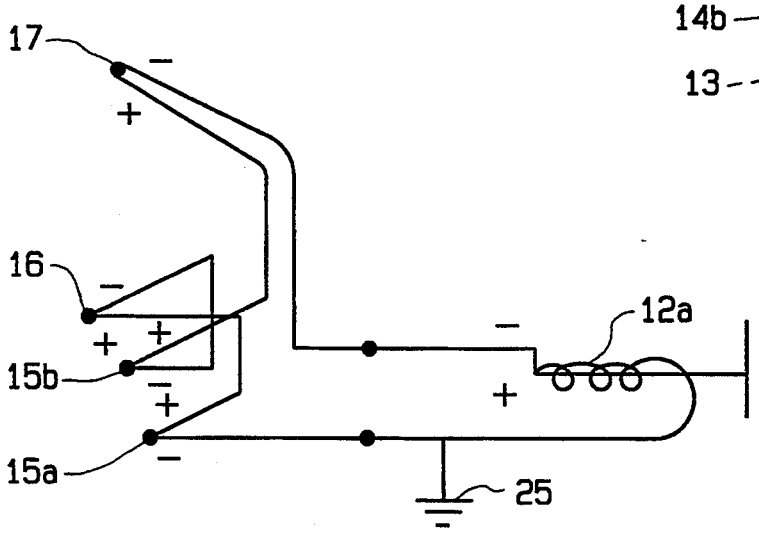
FIG. 3 is an electrical schematic diagram of a preferred control system according to the present invention.

FIG. 3 shows the preferred electrical circuit consisting of the four heat sensors/thermocouples **15*a*, 15*b*, 16 and 17, electrical grounds 25 and valve solenoid 12*a*. The polarity shown at 12*a* is that which opens valve 12. As shown in FIG. 3, the thermocouples 16 and 17 support the open circuit while thermocouples 15*a* and 15*b*** oppose the open circuit.

Figure 5:
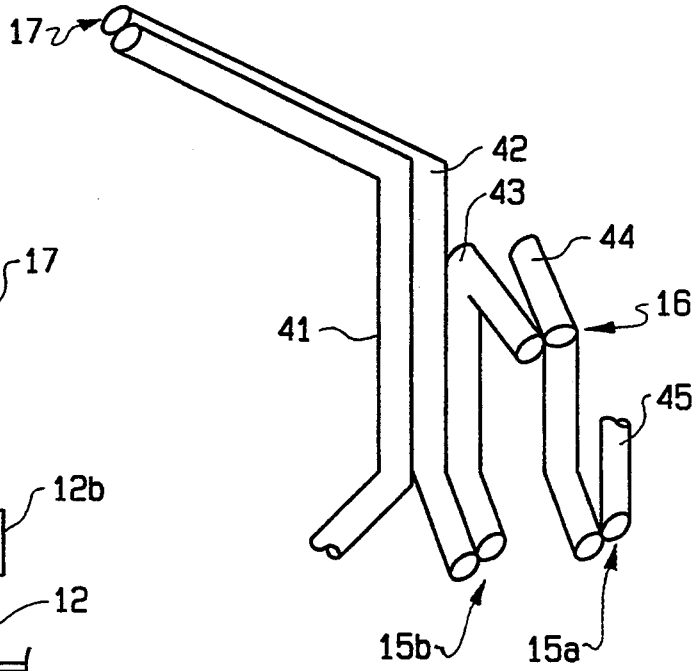
FIG. 5 is a perspective view of the thermocouple assembly according to the present invention.

In the preferred embodiment, shown in FIG. 5, the thermocouples 15a, 15b, 16 and 17 are preferably constructed of Alumel and Chromel, 0.102 inch diameter wires. Chromel wire 42 is used to form both thermocouple 17 and 15*b*, alumel wire 43 is used to form thermocouples 15*b* and 16 and chromel wire 44 is used to form thermocouples 16 and 15*a*. Alumel wire 41 is connected to negative side of solenoid 12*a* and the alumel wire 45 is connected to the positive side of solenoid 12*a*. By using this construction, the wires 42, 43 and 44 are used both as an interconnection between thermocouples and as one half of each junction of the thermocouples as shown in FIG. 5. In this manner, the system provides a system control system based on the additive effect of the thermocouples 16 and 17 minus the additive effect of the thermocouples 15*a* and 15*b*. These thermocouples provide approximately 30 mv at 1800 degrees Fahrenheit.

A first function of the control system is to shut off the gas when there is no gas flame so that gas does not flow from the burner when it is unlit. A second function is to shut off the gas if the flue is blocked or there is negative pressure in the dwelling so as to cause flue reversal. A third function is to shut off the gas when the two thermocouples 15*a* and 15*b* are heated by the solid fuel source so that the gas burner 19 operates as a fire starter that automatically shuts off. This will save fuel and avoid flash back (combustion inside the gas burner 19).

To operate the gas burner 19 as the primary heat source, no solid fuel is supplied to the heating chamber 10. To light the gas burner 19, a door 27 to the heating chamber 10 is opened, which insures no explosive gas build up. The valve knob 12*b* is depressed or turned to open valve 12 while holding a match or a hand held piezoelectric igniter to the gas burner. Once gas burner 19 is lit, the gas flame temperature and flue flow temperature will increase and thermocouple 16 and 17 will send open signals to the solenoid 12*a*. The valve knob 12*b* must be held against the solenoid for approximately fifteen to thirty seconds for the thermocouples to hold the valve 12 open. Thereafter, the valve 12 will remain open automatically by the solenoid 12*a* as long as the gas flame temperature and flue flow temperature remain high. Thermocouples 15*a* and 15*b* will sense the rise in temperature of heating chamber 10 and bring the electrical system output closer to the solenoid shut off value. In this manner, the sensitivity of the system in general is increased to provide a safe system.

In the event of a gas flame loss, the thermocouple 16 will sense the decrease in gas flame temperature and send a close signal to the solenoid 12*a* and shut off the valve 12. In the event of flue reversal or negative pressure in the dwelling, the thermocouple 17 will sense the decrease in temperature of the combusted gas flow and close the valve 12. Once the valve 12 is closed the thermocouple 16 senses the decrease in temperature from the loss of gas flame and the valve 12 will not automatically reopen.

To operate the gas burner 19 as a solid fuel starter, solid fuel such as wood logs are placed in the heating chamber 10 in front of the gas burner 19. The gas burner 19 is ignited in the same manner described above. In this mode the thermocouples 16 and 17 will initially send signals to the solenoid 12*a* to hold the valve 12 open. However, as the solid fuel catches fire and rises in temperature, thermocouples 15*a* and 15*b* will override thermocouples 16 and 17 and send signals to the solenoid 12*a* to close the valve 12. Again, once the valve 12 is closed and the gas burner 19 goes out, the thermocouple 16 will sense the drop in temperature and prohibit any automatic reopening of the valve 12.

As is evident from the discussion above, two thermocouples 15*a* and 15*b* are used to offset the signals of the thermocouple 16 and 17. Based on the teachings of the present invention contained herein, one skilled in the art may add or subtract heat sensors in various locations and provide for the proper signals through other means such as a control logic device for receiving signals and manipulating them according to predetermined instructions. Further, the addition of remote ignition and thermostatic control also will be evident to anyone experienced in the field.

It is noted that the above description is merely illustrative of the invention, and that numerous modifications and embodiments may be devised by those skilled in the art without departing from the inventive concept herein. Accordingly, the true spirit and scope of the present invention is only to be determined by the claims appended hereto.

I claim:

1. An atmospheric heating device, comprising:

a chamber;

a burner located within said chamber receiving a fluid fuel from a fuel source for providing a flame and producing combusted gas;

a flue in flow series with said chamber for receiving said combusted gas therefrom;

a valve communicating with said burner to control the flow of fuel from said fuel source; and a control system for controlling said valve, wherein said control system comprises:

a first temperature sensor located to sense the flame temperature at the burner to provide a first open signal when the flame temperature is above a predetermined value, a second temperature sensor located approximate said flue to sense the combusted gas temperature therein and provide a second open signal when said combusted gas temperature is above a predetermined value, and actuator means responsive to said control signals to operate said valve in accordance therewith.

2. The atmospheric heating device of claim 1 wherein a third temperature sensor is located within said chamber to sense a chamber temperature and provide a close signal to said actuator means.

3. The atmospheric heating device of claim 2 wherein said temperature sensors are thermocouples.

4. The atmospheric heating device of claim 3 wherein said thermocouples are arranged in a series relation with said mechanism for operating said valve.

5. The atmospheric heating device of claim 4 wherein said actuator for operating said valve is a solenoid.

6. The atmospheric heating device of claim 5 wherein at least one electrically opposed thermocouple is located to sense heat from a solid fuel source and provides a close signal to said solenoid to close said valve when said heat from said solid fuel is above a predetermined value.

7. The atmospheric heating device of claim 6 wherein said third thermocouple and said at least one electrically opposed thermocouple are the same.

8. The atmospheric heating device of claim 7 wherein said thermocouples are made of interconnecting wires.

9. The atmospheric heating device of claim 2 further comprising:

a fuel flow path from said valve to said burner;

air venting means for introduction of air into said fuel flow path; and an orifice, up stream from said air venting means, for expanding the fuel flow along said path prior to combining said fuel with said air.

10. The atmospheric heating device of claim 9 wherein said air venting means includes a shroud for directing air flow and said orifice is recessed in said shroud.

11. The atmospheric heating device of claim 1 wherein a third temperature sensing device is located to measure a chamber temperature in said chamber and provides a weaken signal to said actuator as said chamber temperature increases, thereby increasing the sensitivity of said actuator to said first open signal.

12. The atmospheric heating device of claim 11 wherein said plurality of temperature sensing devices and said actuator are coupled in electrical series.

13. The atmospheric heating device of claim 12 wherein said temperature sensing devices use interconnecting wires as junctions for said temperature sensing devices.

14. The atmospheric heating device of claim 13 further comprising:

a fuel flow path between said valve and said burner for delivering fuel to said burner;

air venting means for introduction of air into said flow path; and an orifice, down stream from said air venting means, for expanding said fuel flow prior to combining said fuel with said air.

15. The atmospheric heating device of claim 14 wherein said air venting means includes a shroud for directing air flow and said orifice is recessed in said shroud.

16. A control system, for controlling a gas or liquid fuel burner in a combustion chamber, wherein said chamber communicates with a flue and said burner produces a flame and combusted gas burner fuel receives from a fuel source that is regulated by a valve, said control system comprising:

a first temperature sensor for providing a first control signal indicating the burner flame temperature;

a second temperature sensor for providing a second control signal representative of the combusted gas temperature; and control means responsive to said control signals for closing said valve when the indicated flame temperature or combusted gas temperature fall below predetermined values, whereby fuel flow is stopped in the event of flame outage or backflow in said flue.

17. The control system of claim 16, further comprising a third temperature sensor for providing a third control signal representative of the chamber temperature and said control means being responsive to said third signal for closing said valve when the chamber temperature exceeds a predetermined value indicating a solid fuel source has been ignited within said chamber.

18. The control system of claim 17, wherein said third temperature sensor provides said control means with a sensitivity increasing control signal when no solid fuel is in said chamber such that the sensitivity of said control means to said first and second control signals is increased.

19. The control system of claim 18 wherein:

said sensors are thermocouples;

said control means comprises a solenoid; and said first and second thermocouples are in electrical series for providing said solenoid with an additive control signal to maintain said valve open unless either a loss of flame from said burner occurs or a flow reversal of combusted products from said chamber occurs.

20. The control system of claim 19 wherein said third thermocouple is in electrical series with and having reverse polarity from said first and second thermocouples.

21. The control system of claim 18, wherein said control means comprises microcomputer means for receiving said control signals and opening and closing said valve in accordance therewith.

22. A method of controlling a valve that regulates fuel supply to a gas burner or liquid fuel burner in a combustion chamber, comprising the steps of:

measuring a flame temperature at said burner;

measuring a combusted gas flow temperature exciting said chamber; and closing said valve in response to one or both said measured temperatures dropping below respective predetermined temperatures.

23. The method of controlling a gas burner according to claim 22, further comprising the steps of:

concurrently measuring the combustion chamber internal temperature; and closing said valve in response to said combustion chamber temperature rising above a predetermined temperature.

* * * * *